US005669258A

United States Patent [19]

Luebke

[11] Patent Number: 5,669,258

[45] Date of Patent: Sep. 23, 1997

[54] TUBE BENDER ANGLE INDICATOR

[75] Inventor: Thomas M. Luebke, Menomonee Falls, Wis.

[73] Assignee: Applied Power Inc., Butler, Wis.

[21] Appl. No.: 664,066

[22] Filed: Jun. 13, 1996

[51] Int. Cl.[6] ..... B21D 7/14

[52] U.S. Cl. ..... 72/31.04; 72/37; 72/458; 33/377; 33/379

[58] Field of Search ..... 72/457, 458, 459, 72/31.04, 37; 33/371, 373, 377, 379

[56] References Cited

U.S. PATENT DOCUMENTS

| | | | |
|---|---|---|---|
| 2,932,225 | 4/1960 | Gardner | 72/459 |
| 2,953,048 | 9/1960 | Brown | 72/459 |
| 3,464,247 | 9/1969 | Beckwell | 72/37 |
| 4,425,784 | 1/1984 | D'Gerolamo | 72/459 |
| 4,622,837 | 11/1986 | Bergman | 72/459 |
| 5,058,407 | 10/1991 | Parker | 72/37 |
| 5,144,823 | 9/1992 | Wood | 72/459 |

*Primary Examiner*—David Jones
*Attorney, Agent, or Firm*—Quarles & Brady

[57] ABSTRACT

A tube bender angle indicator is attached to the handle of a manual tube bender and has a frame to which angle indicia are applied which define an apex through which a pointer is pivotally connected to the frame. A bubble level vial is secured to the pointer so as to indicate that the bend angle has been achieved which the pointer is pointing at when the bubble is in its horizontal reference position.

7 Claims, 3 Drawing Sheets

TUBE BENDER ANGLE INDICATOR

BACKGROUND OF THE INVENTION

1. Field of the Invention

This invention relates to tube or conduit benders and in particular to an angle indicator for a manual type tube bender.

2. Discussion of the Prior Art

Conduit benders, or tube benders as they are known, are commonly used by electricians and others, mainly for bending conduit to run wires and cable through. Such a conduit bender is described, for example, in U.S. Pat. Nos. 4,442,695 and 4,622,837.

This type of tube bender typically comprises two parts: a handle and a body. The handle is screwed into the body and the body has an arcuate shoe at the bottom with a groove in the bottom of the shoe into which the conduit fits. The body has a hook which is hooked around the conduit received in the groove and the conduit is bent by exerting a force on the handle to roll the shoe along the conduit, with the conduit between the floor and the shoe.

In doing electrical work, the conduit is bent at a certain angle to accommodate the job, approximate to within a few degrees for a neat looking job. Various means have been proposed for producing a relatively accurate angle of bend in the use of hand tube benders. Since 45° angles and 90° angles are fairly common in the use of such benders, level vials have been mounted on the shoe so that the bubble of the vial would indicate the corresponding angle (45° or 90°) when the shoe was oriented as such, which would be the angle of the tube if the tube started out straight. See, for example, U.S. Pat. No. 4,622,837. Approximate markings may be placed on the shoe to indicate a finite number of other common angles, for example, 22°, 30°, or 60°, to give a rough visual approximation of those angles.

However, there has been a need for a bend angle indicator which would give a relatively accurate indication of any angle between zero and 90°. One solution to the problem is disclosed in U.S. Pat. No. 4,425,784. This angle indicator is attached to the handle of the tube bender and has an arcuate bubble vial with a scale to indicate certain angles associated with the bubble position. While in theory it would appear possible to use the device of the '784 patent for relatively accurate bend angle indications, the device is relatively bulky and expensive to make because of the long arcuate vial required. In addition, during the bending process, the angle indicator disclosed in the '784 patent requires constant monitoring of the bubble itself relative to relatively fine angle indications to determine if the desired angle has been reached.

SUMMARY OF THE INVENTION

The invention provides a tube bender angle indicator, which assures quick, accurate bends and is inexpensive to make. An indicator of the invention has a frame with angle scale indicia thereon, the angle scale identifying various bend angles and defining an apex. An angle pointer is connected to the frame to pivot about an axis which approximately intersects the apex. The pointer is rotatable relative to the frame about the axis to select one of the bend angles. A level is secured to the pointer for indicating when the level is in a certain reference orientation, horizontal in the preferred embodiment.

In one aspect, an angle indicator of the invention has its frame secured to a tube bender, preferably to the handle of the bender.

In another useful aspect, the level is a bubble level vial, preferably straight. The vial can be secured to an upper surface of the pointer so that it is easily visible by the user.

In a preferred form, both sides of the frame have bend angle indicia defining an apex common to both sides. The pointer has a hand on each side with which to select an angle on the respective side. Angle indicia and hands on both sides of the frame are useful so that the indicator can be used with either of two different tube benders, which yield a different bend angle when their handles are vertical.

With an angle indicator of the invention, the desired bend angle can be very accurately set prior to bending. The handle of the bender is then operated to bend the conduit, while the operator watches the pointer to determine when it gets close to vertical. When it gets close to vertical, the operator makes a final adjustment to the bend to place the bubble between the lines of the vial, which results in a quickly made and accurate bend.

These and other objects and advantages of the invention will be apparent from the drawings and the detailed description.

DETAILED DESCRIPTION OF THE PREFERRED EMBODIMENTS

Figure 1:
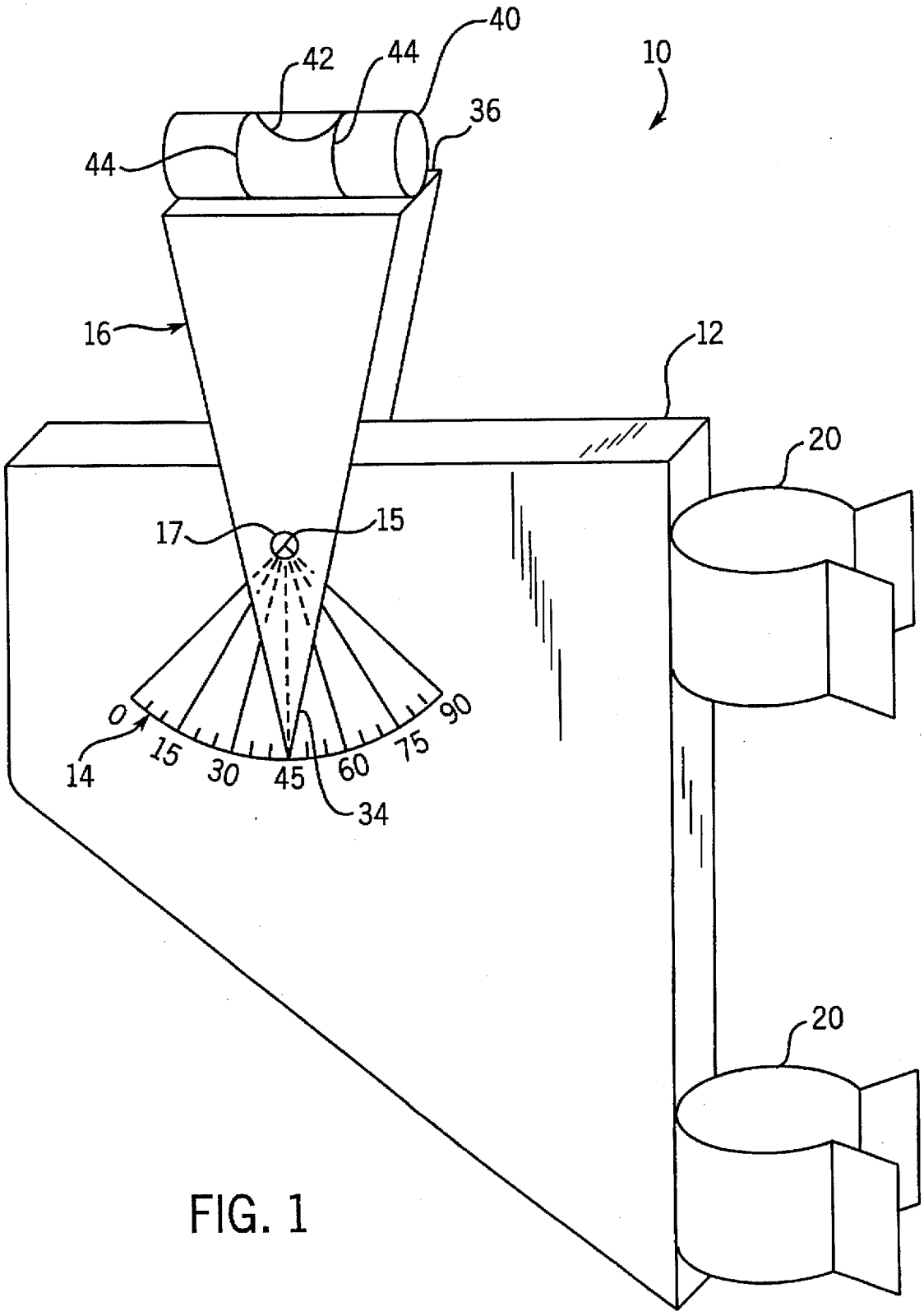
FIG. 1 is perspective view of a tube bender angle indicator of the invention.
Figure 2:
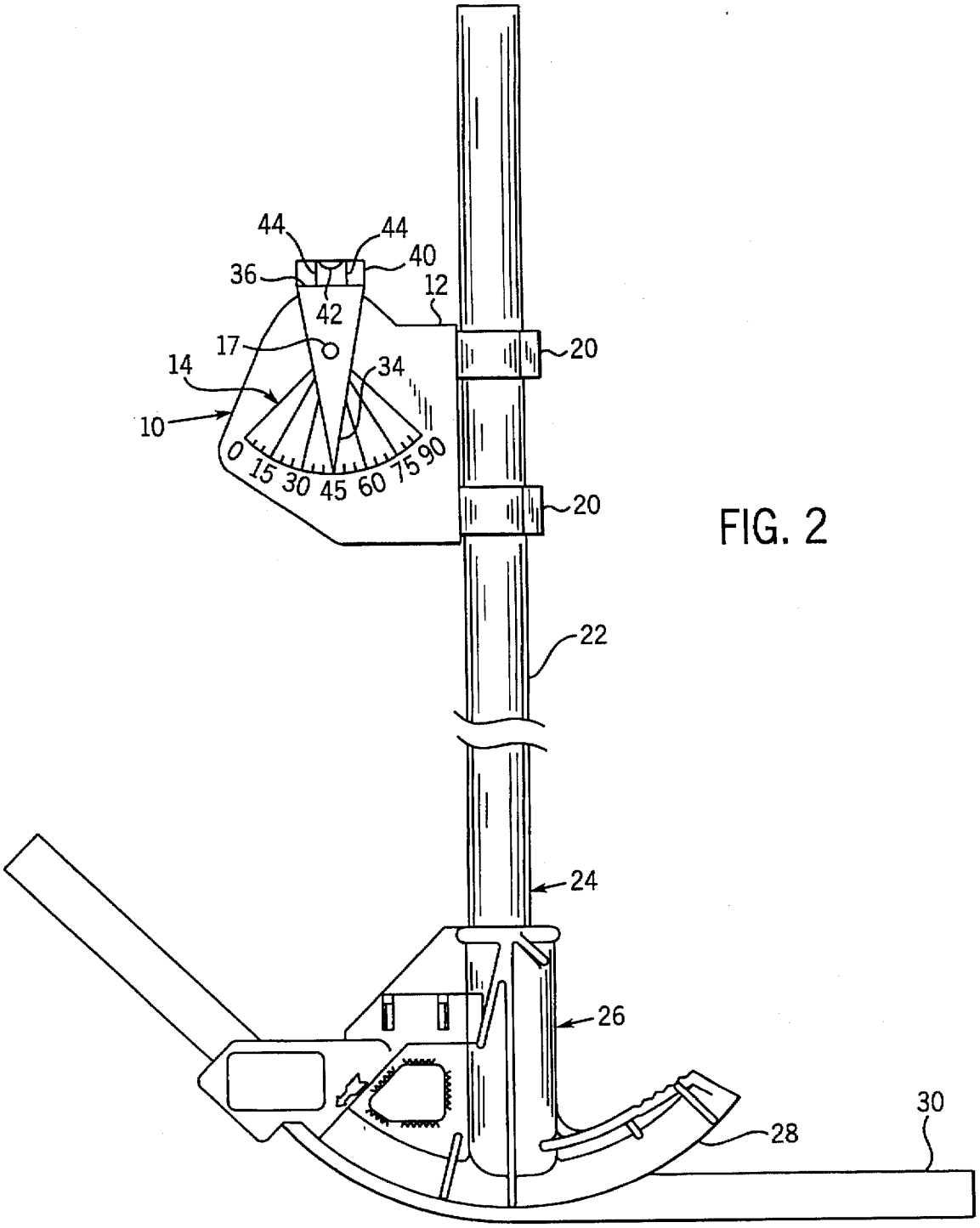
FIG. 2 is a side plan view of the angle indicator of FIG. 1 applied to a tube bender.

Referring to FIGS. 1 and 2, an angle indicator 10 of the invention has a frame 12 with angle scale indicia 14 marked thereon. At the apex 15 of the scale 14, a pointer 16 is pivotally mounted to the frame 12 at pivot 17 so as to rotate about an axis which is through the apex 15 of the scale 14. The frame 12 may be any relatively flat, rigid material, for example, one-quarter inch plywood, a molded plastic component, or similar material and the pointer 16 may be formed of sheet metal, molded plastic or other similar relatively rigid material.

The pivot connection 17 between the pointer 16 and the frame 12 may be formed by any suitable means, such as a bolt or rivet going through the apex 15 of the scale 14. The pivot connection formed should have sufficient friction to hold the pointer 16 at any angle set by the user of the angle indicator.

Figure 3:
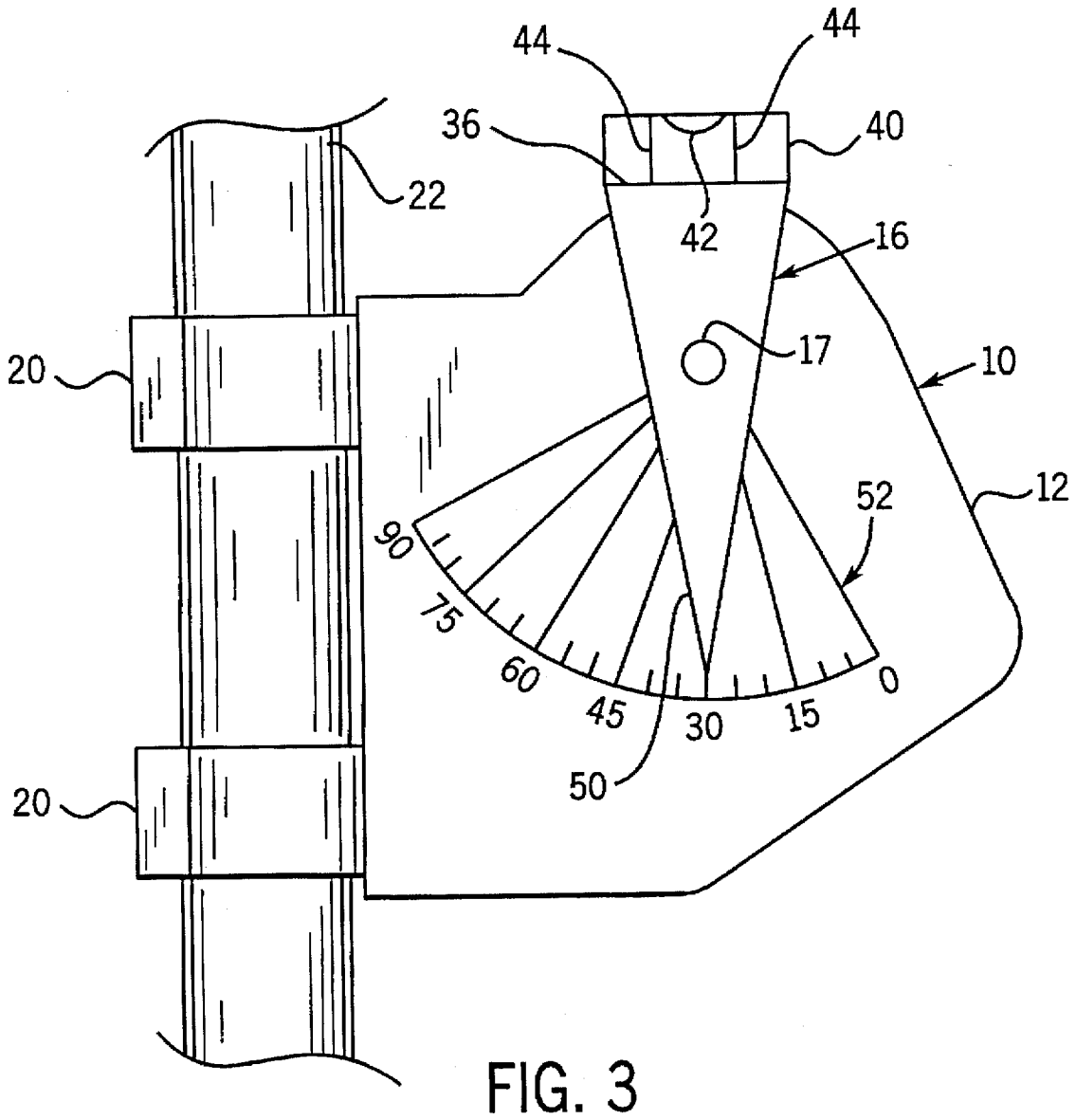
FIG. 3 is a side plan view of the angle indicator of FIG. 2 as viewed from the other side.

Generally U-shaped spring clips 20 are fixed along the side of frame 12 so as to secure the angle indicator 10 to the handle 22 of a tube bender 24 as shown in FIGS. 2 and 3. As illustrated, in addition to the handle 22, the bender 24 has a body 26 with a shoe 28 which may be engaged with a conduit 30 so as to bend the conduit 30 in conventional fashion.

The pointer 16 has a hand 34 which is used to indicate angle on the scale 14. The pointer 16 also has a level vial mounting surface 36 on which is mounted a conventional straight level vial 40, which is filled with a liquid so as to form bubble 42 and has marked thereon horizontal indication lines 44. Vial 40 may be secured to the pointer 16 by any suitable means, for example, an adhesive.

Different types of hand tube benders exist and it is common to find some in which when the handle 20 is vertical, a bend of 45° is produced and others that when the handle 20 is vertical, produce a bend of 30°. To accommodate both types of benders, it is preferred to make the angle indicator 10 so that the pointer 16 also has a hand 50 on its side opposite from the side of the hand 34, as shown in FIG. 3, and to provide a different angle scale 52 on that side of frame 12, which is opposite from the scale 14. Thus, the side of the indicator shown in FIG. 2, with hand 34 and scale 14, would be used if the indicator 10 was assembled to a tube bender in which the angle is 45° when the handle 20 is vertical and the side shown in FIG. 3, with hand 50 and scale 52, would be used if the tube bender angle indicator 10 was applied to a tube bender in which the handle was vertical when the bend angle was 30°.

To precisely bend a certain angle into a conduit using a tube bender 24 equipped with an angle indicator 10, the user first determines which side of the indicator 10 applies to the particular bender being used, as stated above. If the bender 24 is used, which has its handle 20 vertical for a 45° angle, the side shown in FIG. 2 is used. The user then pivots the pointer 16 to indicate the desired bend angle, assuming the conduit starts out straight. The user then engages the shoe 28 with the conduit 30 and operates handle 20 to bend the conduit until the level vial 40 indicates it is horizontal by the bubble 42 being positioned between the lines 44.

If a conduit already has a turn bent into it, an indicator 10 of the invention can be used to measure the angle of the bend. The bender 24 is engaged with the conduit with the shoe positioned at the bend and in the plane of the bend, as shown in FIG. 2. The pointer 16 is then pivoted until the bubble 42 indicates a level state, and the angle at which hand 34 is pointing is read to indicate the angle of the bend. If a certain angle is desired to be added to the already bent conduit, the additional angle is added to the existing measurement, the pointer 16 rotated to indicate the sum total angle, and the handle 20 operated to bring the bubble 42 between the lines 44.

It is noted that an indicator of the invention actually gives at least three different ways of telling if a desired bend angle has been reached. Gross or general indications are given by quickly looking to see if the tip of the hand of the pointer is on an imaginary vertical line directly below the pivot point, i.e., if the pointer 16 is oriented vertically. If so, or if it's close, the user looks at the bubble to accurately adjust the angle. A gross indication of angle is also given by observing if the vial 40 or the top of the pointer 16 is horizontal. If so, the user observes the bubble to accurately reach the bend angle.

A preferred embodiment of a tube bender angle indicator of the invention has been described. Many modifications and variations to the preferred embodiment described will be apparent to those skilled in the art. For example, any means could be used to secure the frame 12 to the tube bender such as, for example, a magnet or straps. Therefore, the invention should not be limited to the preferred embodiments described, but should be defined by the claims which follow.

I claim:

1. A tube bender angle indicator, comprising:

a frame having angle scale indicia in a certain orientation thereon, said orientation corresponding to a certain type of tube bender, said angle scale identifying various bend angles of said type of tube bender and defining an apex;

an angle pointer connected to said frame to pivot about an axis which approximately intersects said apex, said frame pointer being rotatable relative to said frame about said axis to select one of said bend angles;

a bubble level vial secured to said pointer for indicating when said vial is in a certain reference orientation relative to the horizon; and means for affixing said frame to said tube bender in a fixed orientation so that said vial is in said reference orientation with said pointer at a zero degree position of said angle scale and said tube bender in a zero degree position.

2. An angle indicator as claimed in claim 1, wherein said means are for affixing said frame to a handle of a tube bender.

3. An angle indicator as claimed in claim 1, wherein said vial is straight.

4. An angle indicator as claimed in claim 3, wherein said vial is secured to an upper surface of said pointer.

5. An angle indicator as claimed in claim 1, wherein both sides of said frame have bend angle indicia defining an apex common to both sides, and said pointer has a hand on each side with which to select an angle on the respective side.

6. A method of bending a tube with a manual tube bender having an angle indicator as claimed in claim 1 fixed to the bender, comprising the steps of:

adjusting said pointer to a desired bend angle; and operating said bender to bend said tube until said level indicates said level is in said reference orientation.

7. A tube bender angle indicator, comprising:

a frame having angle scale indicia thereon, said angle scale identifying various bend angles and defining an apex;

an angle pointer connected to said frame to pivot about an axis which approximately intersects said apex, said frame pointer being rotatable relative to said frame about said axis to select one of said bend angles; and a level secured to said pointer for indicating when said level is in a certain reference orientation;

wherein both sides of said frame have bend angle indicia defining an apex common to both sides, and said pointer has a hand on each side with which to select an angle on the respective side;

wherein said selected bend angle differs from one side to the other for a given angular position of the pointer relative to the frame.

* * * * *